US006510561B1

(12) United States Patent
Hammond et al.

(10) Patent No.: US 6,510,561 B1
(45) Date of Patent: Jan. 28, 2003

(54) DISPENSING DEVICE

(75) Inventors: Geoffrey Robert Hammond, Hull; Malcolm Tom McKechnie, Driffield; Steven Poile, York, all of (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 09/807,527

(22) PCT Filed: Oct. 20, 1999

(86) PCT No.: PCT/GB99/03376

§ 371 (c)(1),
(2), (4) Date: May 18, 2001

(87) PCT Pub. No.: WO00/23663

PCT Pub. Date: Apr. 27, 2000

(30) Foreign Application Priority Data

Oct. 21, 1998 (GB) ..... 9822854

(51) Int. Cl.[7] ..... E03D 9/02
(52) U.S. Cl. ..... 4/231; 4/222; 4/224
(58) Field of Search ..... 4/222, 223, 224, 4/231

(56) References Cited

U.S. PATENT DOCUMENTS

| | | | | |
|---|---|---|---|---|
| 3,133,132 A | | 5/1964 | Loeb et al. | 264/49 |
| 3,173,876 A | | 3/1965 | Zobrist | 252/137 |
| 3,276,586 A | | 10/1966 | Rosaen | 210/90 |
| 3,541,005 A | | 11/1970 | Strathmann et al. | 210/19 |
| 3,541,006 A | | 11/1970 | Bixler et al. | 210/23 |
| 3,546,142 A | | 12/1970 | Michaels et al. | 260/2.1 |
| 3,845,770 A | | 11/1974 | Theeuwes et al. | 128/260 |
| 3,865,108 A | | 2/1975 | Hartop | 128/260 |
| 3,916,899 A | | 11/1975 | Theeuwes et al. | 128/260 |
| 3,949,900 A | * | 4/1976 | Chapel | 4/231 |
| 4,002,173 A | | 1/1977 | Manning et al. | 128/296 |
| 4,077,407 A | | 3/1978 | Theeuwes et al. | 128/260 |
| 4,160,020 A | | 7/1979 | Ayer et al. | 424/15 |
| 4,207,893 A | | 6/1980 | Michaels | 128/260 |
| 4,220,152 A | | 9/1980 | Dresback | 128/260 |
| 4,327,725 A | | 5/1982 | Cortese et al. | 128/260 |
| 4,350,271 A | | 9/1982 | Eckenhoff | 222/386.5 |
| 6,178,564 B1 | * | 1/2001 | Leonard et al. | 4/223 |

FOREIGN PATENT DOCUMENTS

| | | | |
|---|---|---|---|
| DE | 4323692 | 7/1994 | A47K/13/30 |
| WO | WO94/23765 | 10/1994 | A61L/9/12 |
| WO | WO96/41621 | 12/1996 | A61K/9/44 |

OTHER PUBLICATIONS

Copy of GB Search Report for GB 9822854.7 dated Jul. 19, 1999.
Copy of PCT International Search Report for PCT/GB99/03376 dated Jan. 12, 2000.

* cited by examiner

*Primary Examiner*—Gregory L. Huson
*Assistant Examiner*—Tuan Nguyen
(74) *Attorney, Agent, or Firm*—Fish & Richardson P.C.

(57) ABSTRACT

A dispensing device comprising a body defining first and second compartments, separated by a flexible impermeable membrane. The second compartment is closed off by a semi-permeable membrane adjacent which a water container is disposed. An apertured delivery tube leads from the first compartment. The device may be used to dispense a cleaning, disinfectant and/or fragrancing gel into a toilet bowl. On flushing, water enters the container and migrates through the semi-permeable membrane, increasing the pressure in an osmotic agent or swellable hydrogel contained in the second compartment. This imposes a pressure on the flexible impermeable membrane to displace a gel from the first compartment into the toilet bowl through apertures in the tube.

12 Claims, 1 Drawing Sheet

DISPENSING DEVICE

BACKGROUND OF THE INVENTION

The present invention relates to a dispensing device for dispensing a product into a toilet bowl. The device may be used to dispense any desired material into a toilet bowl, for example a cleaning agent, a disinfectant, a fragrance, a colorant, a descaler, or any combination thereof, or any other material useful in the context of sanitary ware. The device may desirably be positioned within the toilet bowl for activation when the toilet is flushed.

The device employs osmosis to provide the motive dispensing force. The use of osmosis in dispensing products is known. Two such devices are described in WO94/23765 and WO96/41621. In both of these devices an air freshener is continuously introduced onto a surface for dissemination into the environment by evaporation. There is a need to supply an active agent to an aqueous environment, such as for example a toilet bowl, intermittently. Neither of these two devices would be suitable for this purpose. It is an object of the invention to provide a dispensing device to satisfy the above need. DE-C-4323692 discloses a device for dispensing a product into a toilet bowl each time the toilet is flushed by virtue of the flush water washing over the product.

SUMMARY OF THE INVENTION

In accordance with a first aspect of the present invention, there is provided a dispensing device for dispensing a product into a toilet bowl, the device comprising a housing defining a first compartment in which product to be dispensed is in operation disposed, a second compartment adjacent the first compartment in which an expandable material is to be disposed, a partition disposed between the first and second compartments, a container disposed adjacent the second compartment, a semi-permeable membrane disposed between the second compartment and container through which fluid may migrate from the container to the second compartment to increase, in operation, pressure in the second compartment, which pressure may be transmitted through the partition to displace product to be dispensed from the first compartment, wherein the dispensing device has means for securement to a toilet bowl in such a manner that flush water charges the container.

In accordance with a second aspect of the present invention there is provided a method of delivery of said product into a toilet bowl, the method comprising locating a device of the first aspect on the toilet bowl such that the container receives flush water and thereby causes said product to be dispensed intermittently or continuously into the toilet bowl.

DETAILED DISCLOSURE

Figure 1:
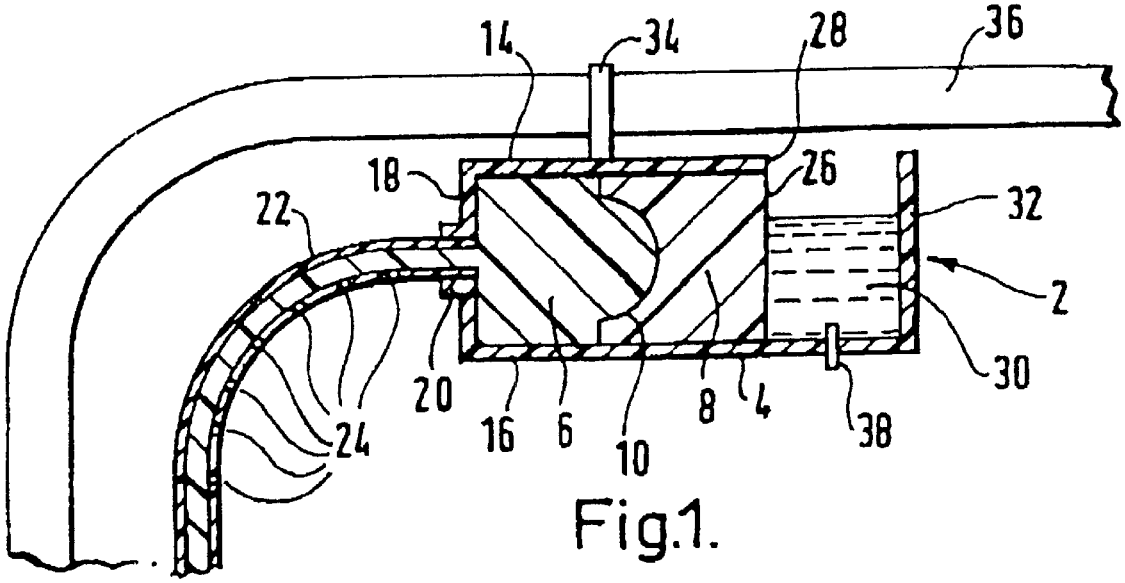
FIG. 1 diagrammatically shows in section a dispensing device for use inside a toilet bowl.

In a preferred embodiment of the invention, the partition comprises a flexible impermeable membrane or a piston.

A tube is advantageously connected to the first compartment, through which tube product may be dispensed. The tube may have a plurality of apertures through which product may be distributed. The tube may be open ended but is preferably closed. The tube may taper along its length and may be of a length sufficient to extend around the toilet bowl, or it may be of shorter length.

A drain is preferably provided in the container, through which drain liquid may be drained. A plurality of such drains may be provided of differing sizes, each of which may be provided with a breachable seal. Alternatively, or in conjunction with the above, the container may be provided with a tap or the like controlling the rate at which water can drain from the container. This is in order that the consumer has a degree of control over the rate at which product is dispensed from the device. This rate is determined by the pressure exerted on the partition by the expandable material. This pressure is, in turn, determined by the rate of expansion of the expandable material, which parameter is controlled by the rate of flow of water through the semi-permeable membrane. Where supply of water to the container is provided intermittently from an external source, e.g. toilet flush water, this flow rate is determined by the amount of water in the container, and this depends on the number, size and position of the drain holes in the container. The optimum number, size and position of the drain holes may easily be determined by trial and error.

An attachment means is preferably provided for attaching the device to a toilet bowl. The attachment means could, in principle, secure the device to the internal surface of a toilet bowl but preferably the attachment means is adapted to engage the rim of a toilet bowl, to position the housing within the toilet bowl. Suitably, such an attachment means comprises a generally U-shaped opening, in use downardly open and adapted to engage resiliently over the rim of the toilet bowl.

Means may be provided enabling the first compartment to be re-charged.

Suitably, the container may be upwardly open with the result that each time the toilet is flushed some flush water flows readily into the container. Thus preferably the device is able to deliver a charge of said product after each time the toilet is flushed. Intermittent delivery of product may be effected in any one of a number of ways, for example, by allowing water to drain from the container or by the container only admitting a pre-determined aliquot of flush water sufficient only to result in a single discharge. Continuous delivery of product may be achieved by allowing a reservoir of water to be retained in the container to, in so doing, continuously imbibe into the second compartment.

The first compartment preferably comprises product to be dispensed and means may be provided enabling the first compartment to be recharged. Alternatively the device may be sealed and disposable. The product is preferably a gel (including a paste) which is conventionally used in "in-the-bowl" dispensers of agents for the cleansing and deodorising of toilet bowls. The product optionally includes a limescale remover, a perfume or fragrant material, a colorant or dye and/or a disinfectant.

The expandable material is preferably an osmotically effective agent and/or a swellable hydrogel. Suitable materials for use as the swellable hydrogel include polymeric materials optionally blended homogeneously or heterogeneously with osmotically effective agents. The polymeric material is optionally of plant, animal or synthetic origin. The material interacts with water or a biological fluid by absorbing the water or fluid and swelling or expanding to an equilibrium state. The polymeric material preferably exhibits the ability to retain a significant fraction of imbibed fluid in its polymeric molecular structure.

Preferably the polymeric material is a gel polymer that can swell or expand to a very high degree; for example it can have a 2- to 50-fold volume increase. A suitable gel polymer is a swellable, hydrophilic polymer (or an osmopolymer) which is optionally either non-cross-linked or lightly cross-linked. The cross-links can be covalent, ionic or hydrogen bonds so that the polymer possesses the ability to swell in the presence of fluid but does not dissolve in the fluid.

A polymeric material suitable for use in the expandable material is, for example, a poly(hydroxyalkylmethacrylate) having a molecular weight of from 5,000 to 5,000,000; poly(vinylpyrrolidone) having a molecular weight of from 10,000 to 360,000; an anionic and/or cationic hydrogel; a poly(electrolyte) complex; poly(vinyl alcohol) having a low acetate residual; a swellable mixture of agar and carboxymethyl cellulose; a swellable composition comprising methyl cellulose mixed with a sparingly cross-linked agar; a water-swellable copolymer produced by a dispersion of finely divided copolymer of maleic anhydride with styrene, ethylene, propylene or isobutylene; a water-swellable polymer of N-vinyl lactams; a swellable sodium salt of carboxymethyl cellulose.

Alternatively the polymeric material can be a gelable, fluid-imbibing and -retaining polymer such as a pectin having a molecular weight ranging from 30,000 to 300,000; a polysaccharide such as agar, acacia, karaya, tragacanth, algins and guar; an acidic carboxy polymer or its salt derivative such as one sold under the trademark Carbopol; a polyacrylamide; a water-swellable indene maleic anhydride polymer; a polyacrylic acid having a molecular weight of 80,000 to 200,000 such as one sold under the trademark Good-rite; a polyethylene oxide polymer having a molecular weight of 100,000 to 5,000,000 such as one sold under the trademark Good-rite; a starch graft copolymer; an acrylate polymer with water absorbability of about 400 times its original weight such as one sold under the trademark Aqua-Keep; a diester of polyglucan; a mixture of cross-linked poly(vinyl alcohol) and poly (N-vinyl 2 pyrrolidone); or poly(ethylene glycol) having a molecular weight of 4,000 to 100,000.

Other suitable polymer materials for use as the expandable member are those disclosed in U.S. Pat Nos. 3,865,108, 4,002,173, 4,207,893, 4,220,152, 4,327,725 and 4,350, 271, and in Scott et al, Handbook of Common Polymers, CRC Press, Cleveland, Ohio (1971); all of which are incorporated herein by reference.

The osmotically effective agent is in general an osmotically effective solute which is soluble in fluid imbibed into the expandable material such that there is an osmotic pressure gradient across the semi-permeable membrane against the fluid in the container. A suitable osmotically effective agent is, for example, magnesium sulphate, magnesium chloride, sodium chloride, lithium chloride, potassium chloride, potassium sulphate, sodium sulphate, sodium phosphate (including hydrates thereof), mannitol, urea, sorbitol, inositol, sucrose, dextrose, lactose, fructose, glucose, magnesium succinate, sodium carbonate, sodium sulphite, sodium bicarbonate, potassium acid phthalate, calcium bicarbonate, potassium acid phosphate, raffinose, tartaric acid, succinic acid, calcium lactate or mixtures thereof. The osmotic pressure in atmospheres (atm) of the osmotically effective agents suitable for use in the invention must be greater than zero atm, generally from 0.1 atm up to 10 atm, or higher.

The solution of the osmotically effective agent exhibits an osmotic pressure gradient against the fluid in the container, and is preferably a saturated aqueous salt solution. To maintain the solution saturated and therefore to achieve a constant osmotic pressure throughout operation of the device, the expandable member containing the solution also contains an excess of the osmotically effective agent in solid form. The amount of the excess osmotically effective agent depends on the size of the system and the amount of product to be delivered. The excess solid can be in the form of dispersed particles or, preferably, in the form of a pellet. The solution can initially be a solution of the same or of an osmotically effective agent different from the solid excess agent.

The semi-permeable membrane disposed between the second compartment and container is permeable to water but impermeable to the expandable material. Examples of suitable semi-permeable membranes include semi-permeable homopolymers or copolymers. For example the semi-permeable membrane is based on a cellulose ester, cellulose monoester, cellulose diester, cellulose triester, cellulose ether, cellulose ester ether; mono-, di- and tri-cellulose alkanylate; mono-, di- and tri alkenylate; and/or mono-, di- and tri-aroylate. Suitable examples of cellulose esters include cellulose acylate, cellulose diacylate, cellulose triacylate, cellulose acetate, cellulose diacetate, and cellulose triacetate.

The cellulose polymers suitable for use as the semi-permeable membrane have a degree of substitution (D.S.) on their anhydroglucose unit from greater than zero to 3. The "degree of substitution" is the average number of hydroxyl groups originally present on the anhydroglucose unit which have been replaced by a substituting group or converted into another group. The anhydroglucose unit can be partially or completely substituted with groups such as acyl, alkanoyl, aroyl, alkyl, alkenyl, alkoxyl, halogen, carboalkyl, alkylcarbamate, alkylcarbonate, alkylsulphonate, and other semi-permeable polymer forming groups which would be known to a person of skill in the art.

A suitable polymer for use as the semi-permeable membrane includes: a cellulose acetate having a D.S. of 1.8 to 2.3 and an acetyl content of 32% to 39.9%; cellulose diacetate having a D.S. of 1 to 2 and an acetyl content of 21% to 35%; and/or cellulose triacetate having a D.S. of 2 to 3 and an acetyl content of 34% to 44.8%. More specifically, suitable cellulosic polymers include: cellulose propionate having a D.S. of 1.8 and a propionyl content of 38.5%; cellulose acetate propionate having an acetyl content of 1.5% to 7% and a propionyl content of 39% to 42%; cellulose acetate propionate having an acetyl content of 2.5% to 3%, an average propionyl content of 39.2% to 45% and a hydroxyl content of 2.8% to 5.4%; cellulose acetate butyrate having a D.S. of 1.8, an acetyl content of 13% to 15% and a butyryl content of 34% to 39%; cellulose acetate butyrate having an acetyl content of 2% to 29.5%, a butyryl content of 17% to 53% and a hydroxyl content of 0.5% to 4.7%; cellulose triacylates having a D.S. of 2.9 to 3, such as cellulose trivalerate, cellulose trilaurate, cellulose tripalmitate, cellulose trioctanoate, and cellulose tripropionate; cellulose diesters having a D.S. of 2.2 to 2.6, such as cellulose disuccinate, cellulose dipalmitate, cellulose dioctanoate, and cellulose dicaprylate; cellulose propionate morpholinbutyrate; cellulose acetate butyrate; cellulose acetate phthalate; mixed cellulose esters, such as cellulose acetate valerate, cellulose acetate succinate, cellulose propionate succinate, cellulose acetate octanoate, cellulose valerate palmitate, cellulose acetate heptonate, and the like. Suitable semi-permeable polymers are disclosed in U.S. Pat. No. 4,077,407, which is incorporated herein by reference, and they can be made by procedures described in *Encyclopedia of Polymer Science and Technology,* Vol. 3. pages 325–354, Interscience Publishers Inc., New York (1964).

Other suitable semi-permeable polymers include cellulose acetaldehyde, dimethyl cellulose acetate; cellulose acetate ethylcarbamate; cellulose acetate methylcarbamate; cellulose dimethylaminoacetate; a cellulose composition comprising cellulose acetate and hydroxypropylmethylcellulose; a composition comprising cellulose acetate and cellulose acetate butyrate; a cellulose composition comprising cellulose acetate butyrate and hydroxypropylmethylcellulose; semi-permeable polyamides; semi-permeable polyurethanes; semi-permeable polysulphanes; semi-permeable sulphonated polystyrene; crosslinked selectively semi-permeable polymers formed by the coprecipitation of a polyanion and a polycation as disclosed in U.S. Pat. Nos. 3,173 876, 3,276,586, 3,541,005, 3,541,006 and 3,546,142, all of which are incorporated herein by reference; selectively semi-permeable silicone rubbers; semi-permeable polymers as disclosed by Loeb and Sourirajan in U.S. Pat. No. 3,133,132, incorporated herein by reference, semi-permeable polystyrene derivatives; semi-permeable (polysodium-sytrenesulphonate); semi-permeable poly (vinylbenzyltrimethyl) ammonium chloride; semi-permeable polymers exhibiting a fluid permeability of from $10^{-1}$ to $10^{-7}$ (cc.mil/cm$^2$hr-atm) expressed as per atmosphere of hydrostatic or osmotic pressure difference across a semi-permeable wall. The polymers are known to the art in U.S. Pat. Nos. 3,845,770, 3,916,899 and 4,160,020, all of which are incorporated herein by reference; and in J. R. Scott and W. J. Roff, *Handbook of Common Polymers,* CRC Press, Cleveland, Ohio, (1971).

The semi-permeable membrane preferably does not move significantly as the expandable material expands. This is in order that the pressure generated in the system by the expandable material is not applied to the fluid in the container but instead to the product to be delivered. Thus, preferably the semi-permeable membrane is relatively inflexible and/or is supported against movement when the pressure in the second compartment increases.

The impermeable membrane preferably used for the partition must be impermeable to water and the osmotically effective agent. Suitable impermeable materials include polyethylene, compressed polyethylene fine powder, polyethylene terephthalate (such as that marketed under the trademark Mylar), plasticized polyvinyl chloride, metal-foil polyethylene laminates, neoprene rubber, natural gum rubber and rubber hydrochloride such as that marketed under the trademark Pliofilm. These materials are preferably flexible, insoluble and chemically compatible with the product to be delivered. Additional suitable materials include polystyrene, polypropylene, polyvinyl chloride, reinforced epoxy resin, polymethylmethacrylate, or styrene/acrylonitrile copolymer.

In order that the invention may be more fully understood, one embodiment thereof will now be described, by way of example, with reference to the accompanying drawings.

Referring to FIG. 1 of the drawing, the dispensing device comprises a housing 2. The housing 2 comprises a body 4 moulded from synthetic plastics material and defining two compartments 6 and 8 separated by a flexible impermeable membrane 10. Each compartment is generally enclosed. Compartment 6 is bounded by side walls 12, top wall 14 and bottom wall 16 of the body 4, by impermeable membrane 10 and by end wall 18 of the body. However that end wall 18 of compartment 6 remote from membrane 10 has an outlet 20 which leads to a delivery tube 22. The tube 22 includes a series of delivery apertures 24 spaced along its length. The distal end of the tube 22 is not shown, for clarity, but it is a closed end. Thus, the only exit routes from the tube are the delivery apertures 24.

Compartment 8 is bounded by side walls 12, top wall 14 and bottom wall 16 of the body, by impermeable membrane 10 and by a relatively inflexible semi-permeable membrane 26. The semi-permeable membrane 26 is at the end of the compartment 8 remote from the compartment 6. The top wall 14 of the body 4 terminates at an edge 28 where it meets the semi-permeable membrane.

At the opposite end of the body 4 to the tube 22 is disposed a liquid container 30 bounded by semi-permeable membrane 26, bottom wall 16, side walls 12 and end wall 32 of the body 4, and not having any top wall; that is, being upwardly open. The container 30 may be integrally formed with the body 4 or separately formed and attached to it. A bracket 34 extends from the body 4 enabling it to be attached to the rim 36 of the toilet bowl. The bracket may also be moulded from synthetic plastics material and will usually comprise a hooked portion at its free end to engage over the aforesaid rim 36.

In this embodiment, although this is not shown in FIG. 1, the tube 22 extends around one quadrant of the toilet bowl rim 36, being retained in place by clips (not shown) but, in other embodiments, it may extend around a shorter arc or a longer arc, for example, two quadrants, three quadrants or around substantially the entire rim.

Compartment 6 contains a gel having an active ingredient, compartment 8 contains an osmotic agent (or swellable hydrogel) and container 30 contains water. This would normally be provided automatically on flushing the toilet, but may also be supplied independently. In operation, water from container 30 is absorbed by the osmotic agent (or swellable hydrogel) through the semi-permeable membrane 26. This increases the volume of osmotic agent (or swellable hydrogel) which exerts a pressure on the impermeable membrane 10 displacing gel from compartment 6 until that pressure is released. The displaced gel is distributed along the toilet rim through the spaced apertures 24 in the tube 22.

The migration of water through the semi-permeable membrane 26 is dependent upon the area of the membrane in contact with the water. As the area increases or decreases so the volume of water increases or decreases. By controlling this area, the pressure on the impermeable membrane 10 and the resultant distribution of gel through the tube 22 can be correspondingly controlled. The amount of water entering container 30 can be controlled by appropriate dimensioning of the container. Furthermore, the dwell time of water in the container 30 can be controlled by the use of a drain 38. Varying the size of the drain controls the outflow of water from container 30 and varies the area of semi-permeable membrane in contact with the water. This in effect enables the dispensing device to be tuned. If desired, a series of different drains each covered by a breachable seal can be provided for customer operation. By choosing to break the appropriate seal, the customer can choose one of several different dispensing rates, which may include rates at which dispensing is intermittent and rates at which dispensing is continuous.

Figure 2:
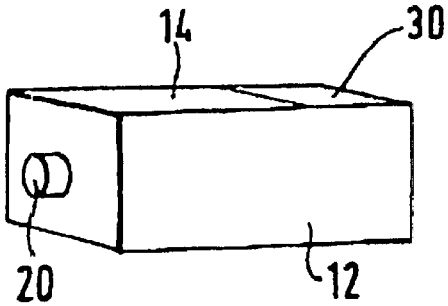
FIG. 2 is a perspective view of one shape of part of the device shown in FIG. 1.
Figure 3:
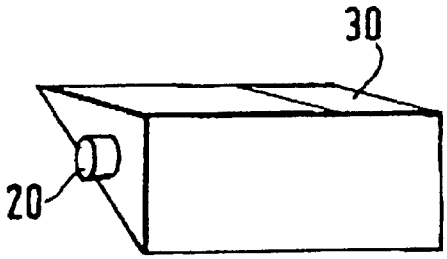
FIG. 3 is a perspective view of an alternative shape to that shown in FIG. 2.
Figure 5:
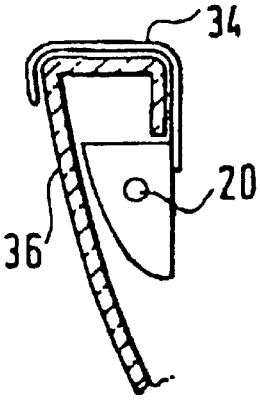
FIG. 5 is a view showing the device of FIG. 4 in position in a toilet bowl.
Figure 4:
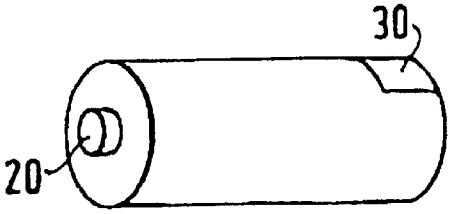
FIG. 4 is a perspective view of a further alternative shape to that shown in FIG. 2.

The device may be square, circular or triangular in section as shown in FIGS. 2, 3 and 4 respectively. The FIG. 3 section may be easier to fit to the toilet bowl as shown in FIG. 5. In FIGS. 2, 3 and 4, tube 22 and bracket 34 have been omitted for clarity and equivalent parts bear the same reference numerals in FIGS. 2–5. In FIG. 5, a part of the rim 36 of the toilet bowl only is shown with bracket 34 and outlet 20. As can be seen with this shape, the device can be made to fit substantially snugly along the surface of the bowl. The tube 22 may be inserted under the rim of the toilet bowl and may be retained in position by clips. As described above the length of the tube 22 may be varied as desired as also may be the number and spacing of the apertures 24.

It will be appreciated that the above embodiments have been described by way of example only and that many variations are possible without departing from the scope of the invention. For example, the flexible impermeable membrane 10 could be replaced by a piston which, in operation, would move under pressure from the osmotic agent in compartment 8 to dispense the gel from compartment 6. Although in the device described, compartment 6 is sealed and therefore not rechargeable, it may be made so as to be rechargeable. The compartment 6 need not contain a gel; other effective embodiments could employ dispensed liquids provided the tube 22 was designed appropriately, to prevent emission of liquid other than when urged from the tube by the pressure caused by the osmotic action described above.

We claim:

1. A dispensing device for dispensing a product into a toilet bowl, the device comprising:

a first compartment in which product to be dispensed is to be disposed, a second compartment adjacent the first compartment in which an osmotic agent or swellable hydrogel is to be disposed, a partition disposed between the first and second compartments, a container disposed adjacent the second compartment, a semi-permeable membrane disposed between the second compartment and the container through which fluid may migrate from the container to the second compartment to increase, in operation, pressure in the second compartment, which pressure may be transmitted through the partition to displace product to be dispensed from the first compartment, wherein the dispensing device has means for securement to the toilet bowl in such a manner that flush water charges the container.

2. The dispensing device as claimed in claim 1, in which the partition comprises a flexible impermeable membrane.

3. The dispensing device as claimed in claim 2, in which a tube is connected to the first compartment, through which tube product may be dispensed.

4. The dispensing device as claimed in claim 3, in which the tube comprises a plurality of apertures.

5. The dispensing device as claimed in claim 2, in which a drain is provided in the container, through which drain liquid in the container may be drained.

6. The dispensing device as claimed in claim 5, in which the drain has a breachable seal.

7. The dispensing device as claimed in claim 6, in which a plurality of such drains of varying sizes are provided.

8. The dispensing device as claimed in claim 2, in which the means for securement is a bracket adapted to engage the rim of a toilet bowl so as to position the housing within the bowl.

9. The dispensing device as claimed in claim 2, in which the container is upwardly open.

10. The dispensing device as claimed in claim 2, adapted to deliver a charge of said product after each time the toilet is flushed.

11. The dispensing device as claimed in claim 2, in which the first compartment contains said product and the second compartment contains said osmotic agent or swellable hydrogel.

12. A method for delivering a product into a toilet bowl, said method comprising securing on a toilet bowl, a device comprising:

a first compartment in which product to be dispensed is to be disposed, a second compartment adjacent the first compartment in which an osmotic agent or swellable hydrogel is to be disposed, a partition disposed between the first and second compartments, a container disposed adjacent the second compartment, a semi-permeable membrane disposed between the second compartment and the container through which fluid may migrate from the container to the second compartment to increase, in operation, pressure in the second compartment, which pressure may be transmitted through the partition to displace product to be dispensed from the first compartment, such that the container receives flush water and thereby causes said product to be dispensed intermittently or continuously into the toilet bowl.

* * * * *